US005533645A

United States Patent [19]

Wittern, Jr. et al.

[11] Patent Number: 5,533,645

[45] Date of Patent: Jul. 9, 1996

[54] SPLIT DOOR FOR VENDING MACHINE

[75] Inventors: Francis A. Wittern, Jr., Des Moines; Gary L. Walke, Bondurant; Joseph F. Nerly, Des Moines, all of Iowa

[73] Assignee: Fawn Engineering Corporation, Des Moines, Iowa

[21] Appl. No.: 332,911

[22] Filed: Nov. 1, 1994

[51] Int. Cl.[6] ..... G07F 11/00

[52] U.S. Cl. ..... 221/76; 221/120; 312/97; 312/139.2

[58] Field of Search ..... 221/76, 69, 87, 221/92, 93, 94, 119, 120, 121, 122, 123, 151, 304, 306; 312/97.1, 97, 91, 138.1, 139, 139.2

[56] References Cited

U.S. PATENT DOCUMENTS

| | | | |
|---|---|---|---|
| 2,811,403 | 10/1957 | Barker et al. | 312/97.1 |
| 3,135,567 | 6/1964 | Braunsberg . | |
| 3,146,043 | 8/1964 | Johnson et al. . | |
| 3,556,284 | 1/1971 | Dyer et al. | 312/97 |
| 3,684,131 | 8/1972 | Kurimsky . | |
| 4,049,330 | 9/1977 | Schlapp . | |
| 4,317,604 | 3/1982 | Krakauer . | |
| 4,391,388 | 7/1983 | Krakauer . | |
| 4,842,161 | 6/1989 | Krakauer | 221/122 |
| 4,927,051 | 5/1990 | Falk et al. . | |
| 5,048,717 | 9/1991 | Falk et al. . | |

OTHER PUBLICATIONS

U.S. application Ser. No. 3/102,762, filed Sep. 3, 1963, Johnson et al.

*Primary Examiner*—H. Grant Skags
*Attorney, Agent, or Firm*—Zarley, McKee, Thomte, Voorhees, & Sease

[57] ABSTRACT

An apparatus and method for maximizing the amount and selection of vendable items from a bucket-type vending machine includes a main access door over an access opening to buckets of the machine. One or more shields are positioned below the access opening but can be selectibly interlocked with the door so that when the access door uncovers the access opening, any of the shields can be raised to cover any or all of the access opening. This arrangement allows each bucket to be subdivided into separate buckets. The selectable shields therefore can close off from access any of the sections of the bucket which are not selected by a customer thereby allowing use of one main access door to facilitate the increased amount and number of selections available from each bucket of the bucket-type vending machine.

14 Claims, 4 Drawing Sheets

SPLIT DOOR FOR VENDING MACHINE

BACKGROUND OF THE INVENTION

A. Field of the Invention

This invention relates to dispensing systems for such things as vending machines, and in particular, to increasing the capacity and selection of a vending machine with compartments accessible by a sliding door.

B. Problems in the Art

A variety of vending machine dispensing systems exist. For example, canned soft drink machines generally use a gravity feed system. A customer pushes a button and one can of the selected brand and/or flavor is released from a row of the same brand and/or flavor and dropped to an access opening. The customer generally does not actually see the different available choices but relies on an indicator (such as a picture, trademark, or logo) at or near each of the buttons.

Other machines, for example candy vending machines, utilize a glass front so the customer can see the choices. Drive mechanisms then operate to move a particular choice to a drop off location accessible by the customer.

In both of the above systems, security against a customer attempting to reach and take more than the single selected item is accomplished by having the access area away from or segregated from the remaining inventory in the machine.

Another type of vending system utilizes a plurality of trays or what will be called buckets that, like a ferris wheel, move in a path so that they sequentially can rotate to a window or door. Many of these machines utilize a window, and in fact combine a window with a door, to allow a customer to not only see the various selections available, but also to verify that the customer's particular selection is moved to the door. The customer usually operates a control to move the buckets past the door until the bucket with the desired item is aligned with the door. Once appropriate money is given to the machine, the door can then be opened and the customer can access the selected product. The individual buckets are segregated from each other to disallow access to other buckets when the door is opened. The door is also configured to limit access to a single bucket.

As with previously discussed vending systems, it is generally advantageous for the customer to be able to actually see the product choices being offered. This is even more indicated if the vending machine offers a wide variety of types of products, as opposed to a soda vending machine, for example, which offers the same sized containers and the interior contents of which are not viewable by the customer anyway. Primary examples of why actual visual inspection of an item is desired are such things as sandwiches, fruit, and the like. It is generally desirable from both the customer's and vendor's standpoint that the actual available products be viewable. Furthermore, if a wide variety of products is desired, it is impractical to constantly change signs and/or symbols on the front of the machine when reloading product and it may not even be possible to effectively identify each available product to the customer. Furthermore, in bucket-type machines, once an item is removed from a bucket, it will remain empty until the vending machine operator reloads the bucket. Therefore, a visual verification of the contents, or lack thereof, of a bucket is important so that the customer does not select an empty bucket.

Another very important consideration with vending machines is maximization of use of the machine. For example, with a soda dispensing machine, a substantial amount of the interior of the housing of the machine can be filled with product. This reduces the labor involved in returning to and reloading the machine and it can also increase the number of selections for an individual machine. While soda dispensing machines are fairly maximized as far as product utilization, such things as candy dispensing machines are limited to an extent by the equipment required for dispensing the products. Motors and the like take up room in the machine and therefor dictate to some extent the number and size of rows and columns that can be fit into the machine.

A similar but also different problem exists with bucket-type machines. Not only does the structure of the bucket mechanism dictate to some extent how many buckets can be put into the machine, the fact that each bucket contains a single selection also effects how many selections are available. Because bucket machines are used for a variety of different types of products, the sizes of the products sometimes vary somewhat significantly. Therefore, a generic bucket or tray is usually used which can be much bigger than some of the products which are vended. This results in less than a maximization of space. Moreover, security reasons, primarily the ability to stop access to other buckets than the one selected, dictate that the door accessing the bucket be as small as possible, thereby also sometimes limiting the size of the buckets themselves.

Some multiple selection vending machines, referred to as carousel machines, utilize rotating horizontally positioned carousels that have radial moveable dividers to accommodate different sized products in each carousel. Each carousel, each rotating at its own vertical level, would therefore have its own door. Either the size of the door for each carousel must be variable for different sized objects, or a standard sized door would limit the amount of adjustment of size of each segment of the carousel. Attempts have even been made to vertically split a horizontal carousel tray into two levels. Additional doors would either have to be utilized or the travel of each door controlled to open one half the distance. In any event, there would be multiple doors if the carousel machine has more than one carousel.

A proposed solution at maximizing the number of selections in bucket type machines involves the use of a single outer window/door to view the products in the various buckets. Each bucket can be subdivided into what will be called sub-buckets by utilizing dividers. In the particular machine being discussed, however, behind the outer window/door are positioned a plurality of sub-doors; one blocking access to each sub-bucket. Once the customer decides on a particular item in a particular sub-bucket, the whole bucket is rotated to line up with the outer window/door, the outer window/door is raised, and then the plurality of secondary doors, each correlated to each sub-bucket, is presented to the customer. The correct money is deposited and a button or control is then pushed for the desired sub-bucket and a motor, one for each sub-door, opens the selected sub-door for the particularly selected sub-bucket.

It can therefore be seen that the need to maximize space in rotating buckets or rotating carousel type machines has been acknowledged in the art. To date, however, attempts to maximize space have either been primarily related to horizontal carousels with adjustable shelves, each shelf requiring its separate door, or using a main door and then separately motorized sub-doors for a sub-divided bucket.

In either case, the plurality of doors involves multiplication of moving parts and thus adds cost and complexity. Some of these attempts require interchangeability of different sized doors or even control of amount of opening of the doors. This would take time to do depending on which items exist in the machine and which items will be subsequently re-stocked into the machine once vended.

There is therefore a real need in the art for an improvement in vending machine systems as to maximizing the amount of products and the selection of products for vending systems particularly those which need or allow the customer to visually review each and every selection in the machine. It is therefore a principle object of the present invention to provide an apparatus and method to solve or improve over the problems and deficiencies in the art.

Other objects, features, and advantages of the invention are:

1. Flexibility with respect to the number of items that can be placed in the vending machine as well as the number of different selections that are available.

2. Flexibility with respect to whether one item or multiple items are available and selectable from a single bucket.

3. Utilization of one large access door that enables access to an entire bucket unless intentionally limited.

4. Allowing wider buckets for a single machine because of the ability to subdivide individual buckets.

5. Maintenance of security as against a customer gaining access to other buckets or non-selected portions of the same bucket.

6. Economical advantage in that it does not require additional drive motors or doors.

7. Durability over repeated operation.

8. Cost effectiveness.

9. Reliability in operation and selection.

10. Increased capacity for the machine.

These and other options, features, and advantages of the present invention will become more apparent with reference to the accompanying specification and claims.

SUMMARY OF THE INVENTION

The present invention comprises an apparatus and method for maximizing the amount and selection of vendable items from a vending machine, particularly a bucket or similar type of vending machine. The method includes subdividing at least one support tray, such as a bucket, for vendable items into two portions; rotating that support tray to an access opening; raising a single access door which ordinarily would allow access to all parts of the support tray; but blocking access to a non-selected section of the divided support tray.

The apparatus of the invention comprises one or more shields placed outside the access opening which is normally covered by the door. A releasable connection exists between the door and shield so that normally the shield will follow the door when the door is raised and block off the entrance opening across its width so that access to the support tray is precluded. However, by specific instruction, if the customer selects a particular section of the support tray, the shield corresponding to that section will not follow the door so that access to the section is allowed. A shield or shields corresponding to any other sections of the support tray, however, would continue to follow the door and block those sections off.

DETAILED DESCRIPTION OF THE PREFERRED EMBODIMENT

A. Overview

Figure 1:
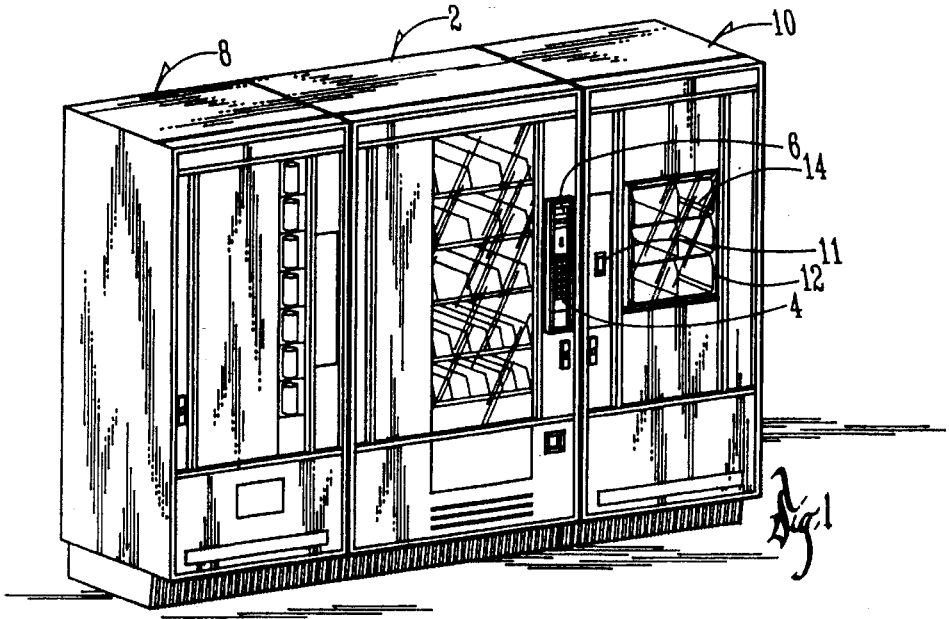
FIG. 1 is perspective view of a vending machine of the bucket-type connected as a satellite unit to one or more other vending machines, at least one having a controller and coin/bill mechanism and/or bill changer that hooks up to the satellite bucket-type machine.

To assist in a further understanding of the invention, a specific preferred embodiment of the invention will now be described in detail. This description is illustrative and does not, nor is it intended to, specifically limit the invention.

The drawings will be frequently referred to in this description. Reference numerals will be used to designate certain parts and locations in the drawings. The same reference numerals will indicate the same parts and locations throughout the drawings unless otherwise indicated.

B. Environment Of The Preferred Embodiment

By referring to FIG. 1, a combination of vending machines is depicted. Machine 2 will be referred to as the master unit because it includes the master control device 4 and a bill/coin validator 6 (such as are well known in the art). Machine 8 will be called a slave or satellite because it is connected (by means well known within the art, such as electrical cable) to master unit 2. Machine 10, is also a slave to master unit 2 and contains a preferred embodiment of the present invention.

Each of the working elements of machines 2, 8, and 10, is controlled by master control 4. A customer would approach the combination of machines 2, 8, and 10, and could select an item or items from any or all three. By putting in the appropriate amount of money or equivalent, and having the same validated by validator 6, the customer simply correlates the vending location indicator (usually alpha/numeric) on master control 4 with the actual physical location of a desired vendable item in any of the machines 2, 8, or 10 and then enters the correct numbers. Master control 4 then instructs the appropriate motors and/or drives and/or doors to be actuated to allow the dispension of and/or access to the desired selection(s). More than one selection is possible.

Machine 10 is a bucket-type vending machine such as is well known in the art. A single access door 12 on the front of machine 10 serves as a window for the customer to visually inspect the contents contained in individual buckets 14 by operating a control (here, for example, shopper button 11) that would rotate buckets past door 12 (which is transparent). Door 12 also is openable (once unlocked by a signal from master control 4) by vertically sliding door 12 to uncover access opening 16 (see FIG. 2) in housing 18 of machine 10. It is important to understand that the raising of access door 12 uncovers enough of access opening 16 to allow the customer access to a single entire bucket 14 that would be positioned behind opening 16 in a vend position. It does not open enough to allow access to any other bucket. Door 12 can have a ⅛" tempered glass external pane and a ⅛" acrylic plastic internal pane (to reduce weight compared to having both be glass panes). The panes are sealed with a butyl rubber sealant.

As can be understood, conventional bucket-type vending machines have one vendable item per bucket. A customer selects a particular bucket holding a desired vendable item by using button 11 to move the selected bucket to a vend position in front of access door 12. The customer then deposits the appropriate amount of money in validator 6 of host machine 2. If validated, the customer then presses an appropriate button (or number and/or letter combination) indicating selection of machine 10. Master control 4 in machine 2 releases access door 12 from a locked normal position covering all of access opening 16. Opening 16 can be a plastic extrusion of rigid polyvinyl chloride (PVC). The customer then lifts access door 12 and retrieves the vendable item from the selected, now exposed bucket. Generally return springs or other mechanisms assist the customer in lifting access door 12. Once the selected item is removed, the door 12 generally returns by gravity back to the normal position where it is automatically locked in place. In some situations a timer waits for a pre-determined period ("times out") and then locks door 12 down. This is the normal environment and operation for bucket-type vending machines.

C. Parts Of The Preferred Embodiment

Figure 2:
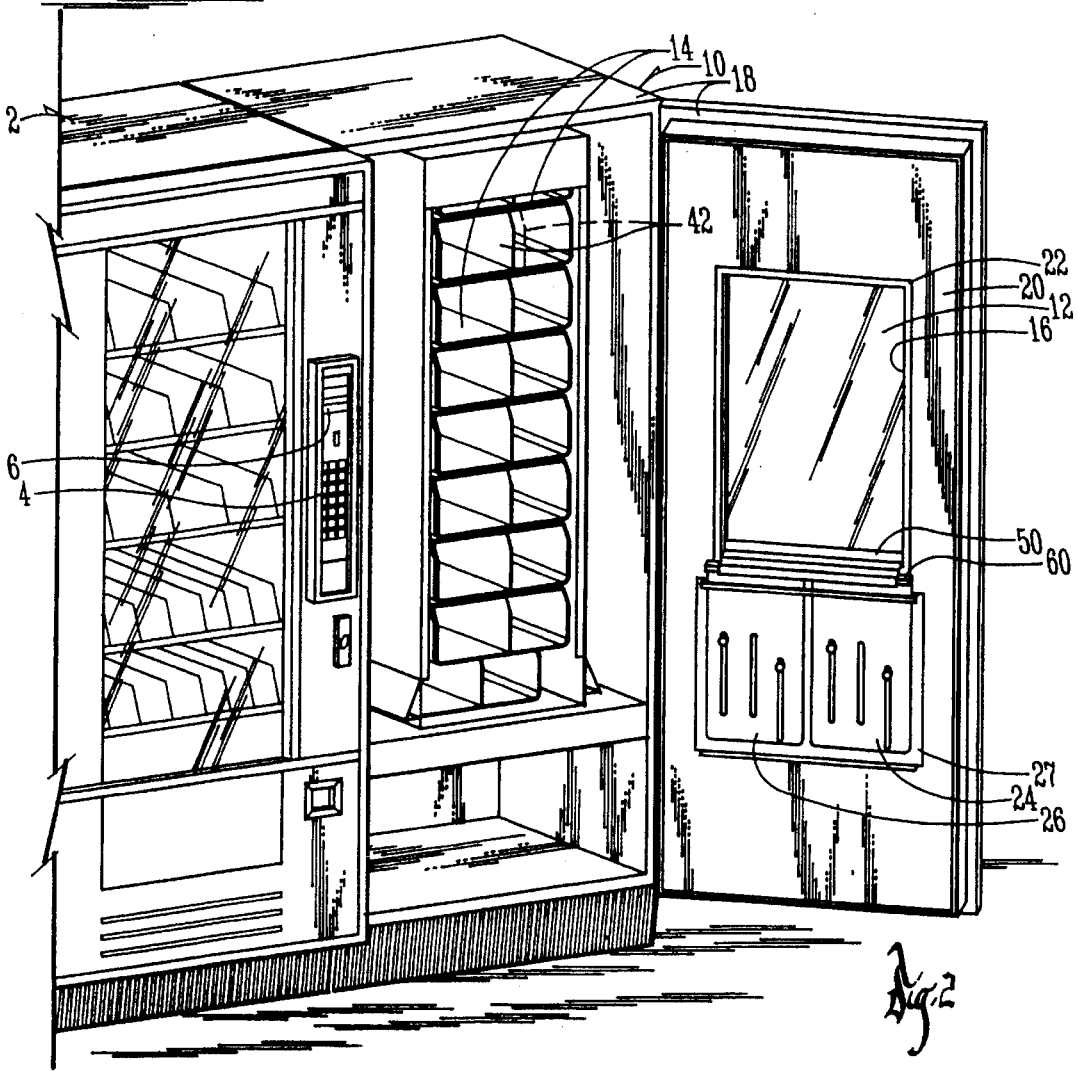
FIG. 2 is an enlarged perspective view isolating the bucket-type vending machine and showing the front facing wall of the machine opened revealing the back side of the customer access opening and access window/door and left and right shields associated with the access door according to the preferred embodiment of the invention.

FIG. 2 illustrates machine 10, including a preferred embodiment of the invention, in more detail. Housing 18 includes a hinged front wall or door 20 that is openable to gain access to buckets 14 for filling buckets 14 or for maintenance on machine 10. Front wall 20 is normally lockable with a key for security purposes. The specifics of the mechanism by which buckets 14 rotate past access opening 16 are well known in the art and will not be discussed in detail here. Buckets 14 are basically attached to a conveyor system which somewhat in the same fashion as a ferris wheel is controllable to rotate buckets 14 around the interior of machine 10 so that they sequentially can pass access opening 16 for visual inspection by the customer. Buckets 14 are always maintained in a horizontal position. FIG. 2 also shows that access door 12 is mounted within a frame 22 in front wall 20 which allows slidable vertical movement from the normal position completely covering all of access opening 16 (as shown in FIG. 2) upwardly to a position uncovering the lower portion of access opening 16 (see FIGS. 3 and 4).

FIG. 2 also shows that in the preferred embodiment, left and right shields 24 and 26 are in a normal position basically underneath access opening 16. Shields 24 and 26 are basically each slightly over one half the width of door 12 and in the preferred embodiment, are generally coplanar with each other but offset slightly from the plane of access door 12. Door 12 is generally double-pane glass, but can be of other materials. Shields 24 and 26 can be of plastic (e.g. 0.090 inch thick polycarbonate).

Each shield 24 and 26 is retained in a vertically slidable fashion to door 20 as follows (see also FIGS. 5–7). A panel 27 (e.g. painted 16 ga. (0.060') CRS weld assembly) is secured to a plate 41 on the inside of front wall 20 by members such as bolts, screws, etc., or by other methods. Separate plate 41 is used so that the whole split door (shield) mechanism can be moved laterally relative to the buckets alter the split location of the bucket. A U-shaped retaining bar 28, part of panel 27, extending laterally from the remainder of panel 27, and defining a slot 29, serves as a guide for shields 24 and 26 (see FIG. 5). Parallel, spaced apart slots 30 and 34 in each shield 24 and 26, correspond to pins 36 and 40 which are fixed to and extend from panel 27 and door 20. Slots 30 and 34 are offset vertically in height to deter any cinching or binding that might occur if they were uniform in position across shields 24 and 26. The tops and bottoms of slots 30 and 34 therefore limit the movement of shields 24 and 26. Slots 38 of shields 24 and 26 receive the arm of a solenoid fixed to a plate 41 (see FIG. 6), and will be described in more detail later. In FIG. 2, shields 24 and 26 are in their normal or down position as determined by the placement of pins 36 and 40 on plate 41. Pins 36 and 40 when at the top of slots 30 and 34 limit further downward travel of shields 24 and 26. As will be discussed later, access door 12 has a flange 50 which cooperates with a mating flange 60 at the top of each shield 24 and 26.

Figure 3:
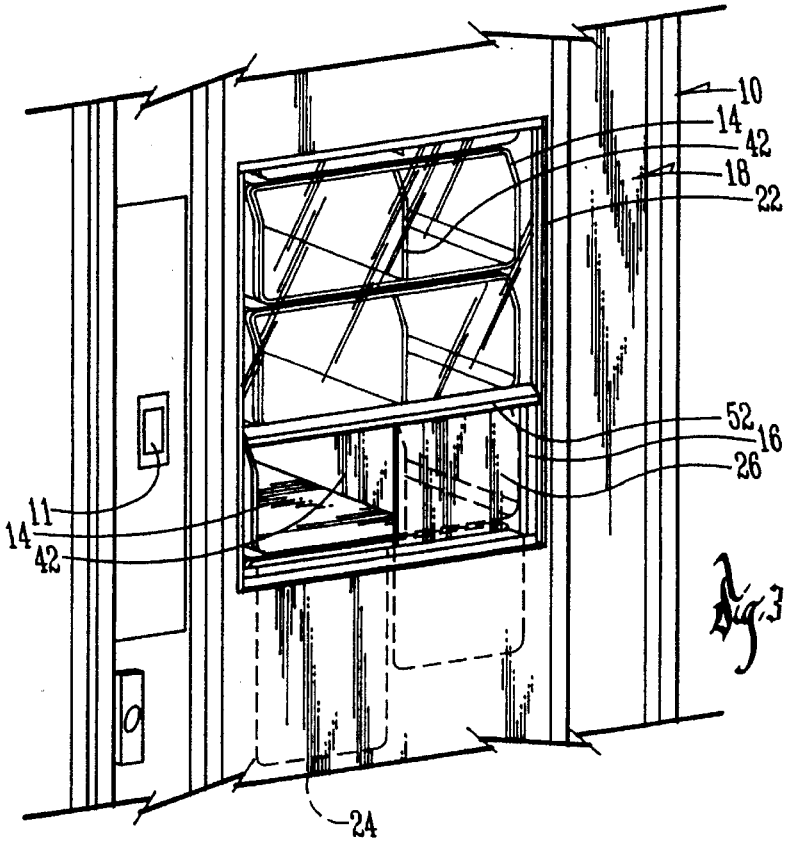
FIG. 3 is a still further enlarged isolated front elevational view of the bucket-type machine showing the access door being raised, the left shield in the down position below the access opening, and the right shield in the up position raised over a portion of the access opening.

FIG. 3 shows shield 26 in its up position, the limit of which is defined by the travel of door 12 and of pins 36 and 40 (steel, SAEll13) in the bottom of slots 30 and 34. Stop bushings could also be placed in the top of each slot to define the limit of movement of pins 36 and 40. In the up position, shield 26 covers and blocks the vertical height of one portion of exposed bucket 14 and blocks the horizontal width of the exposed bucket 14 to the extent of the width of shield 26.

FIG. 3 also illustrates shield 24 in the down position. Thus, if a divider 42 (e.g. 0.090 inch thick high impact polystyrene plastic (HIPS)) (see FIG. 2 also), is placed in a bucket 14, segregating the bucket into two portions, the width of shields 24 and 26 is such that as shown in FIG. 3, if a vendable item on one side of bucket 14 is selected (here the left side), the shield corresponding to that side (left shield 24) will be undisturbed from its normal or down position when door 12 is raised; but the opposite shield (right shield 26) would follow door 12 and block off the non-selected side of bucket 14. As is easily understood, either shield 24 or 26 could be left in the normal down position, with the opposite shield being raised to block off the non-selected side.

Figure 4:
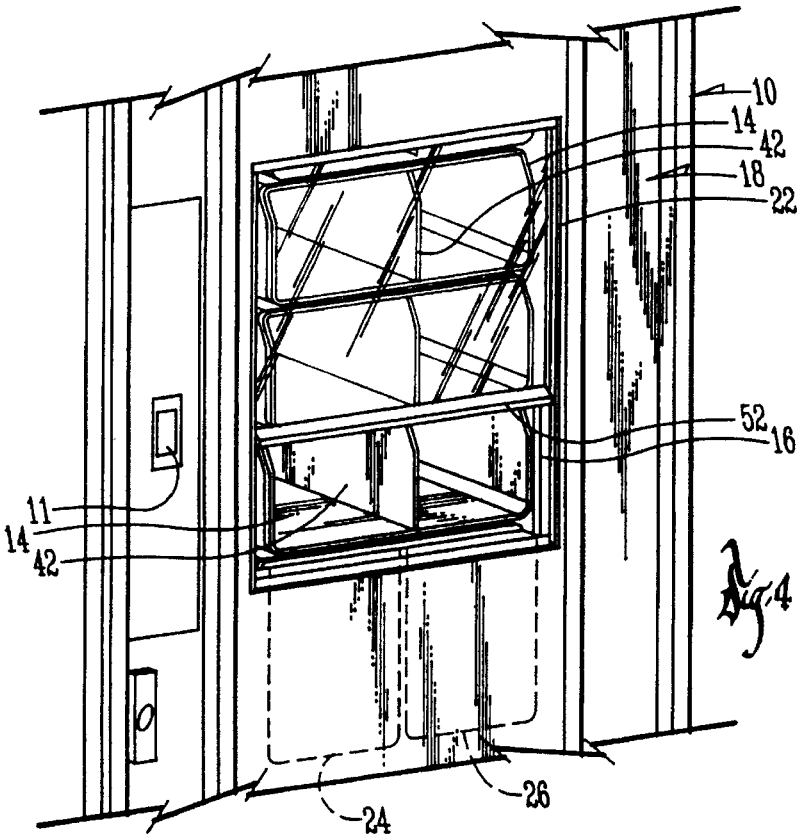
FIG. 4 is similar to FIG. 3 except showing the access door raised and both shields in the down position so that the customer can access all parts of the exposed bucket.

FIG. 4 shows, however, that there may be instances in which both sides of tray or bucket 14 (the portions of bucket 14 on either side of divider 42) are to be validly accessed. In that instance, both shields 24 and 26 would be left in the normal down position when door 12 is raised. An example would be if a customer selects vendable items (e.g. an apple on one side and a sandwich on the other) from both sections of a bucket 14. Alternatively, divider 42 can be removed allowing the vending of one large item per bucket (e.g. a platter of food).

Figure 5:
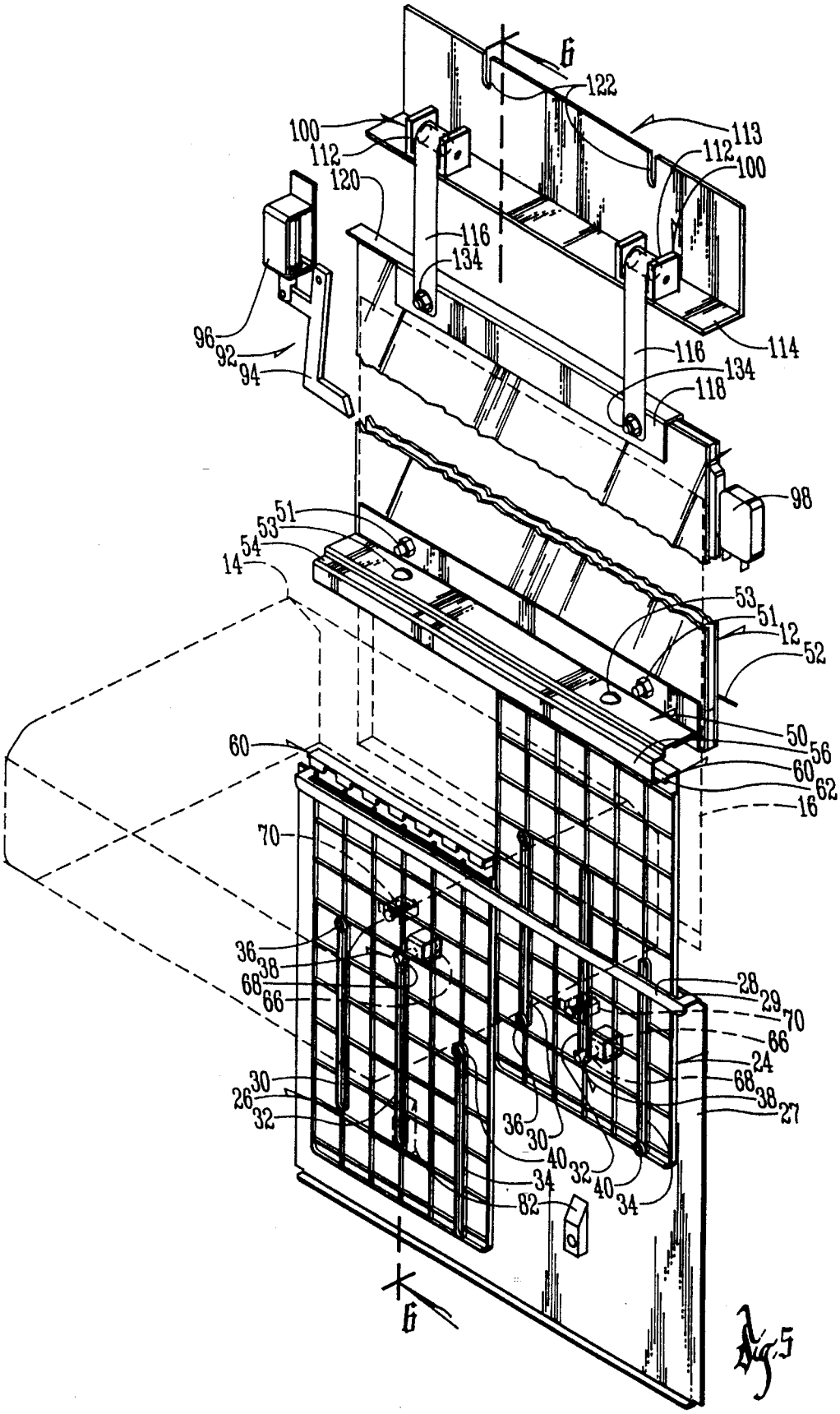
FIG. 5 is an enlarged isolated rear perspective view of the access door and shields according to the preferred embodiment of the invention.
Figures 6, 7:
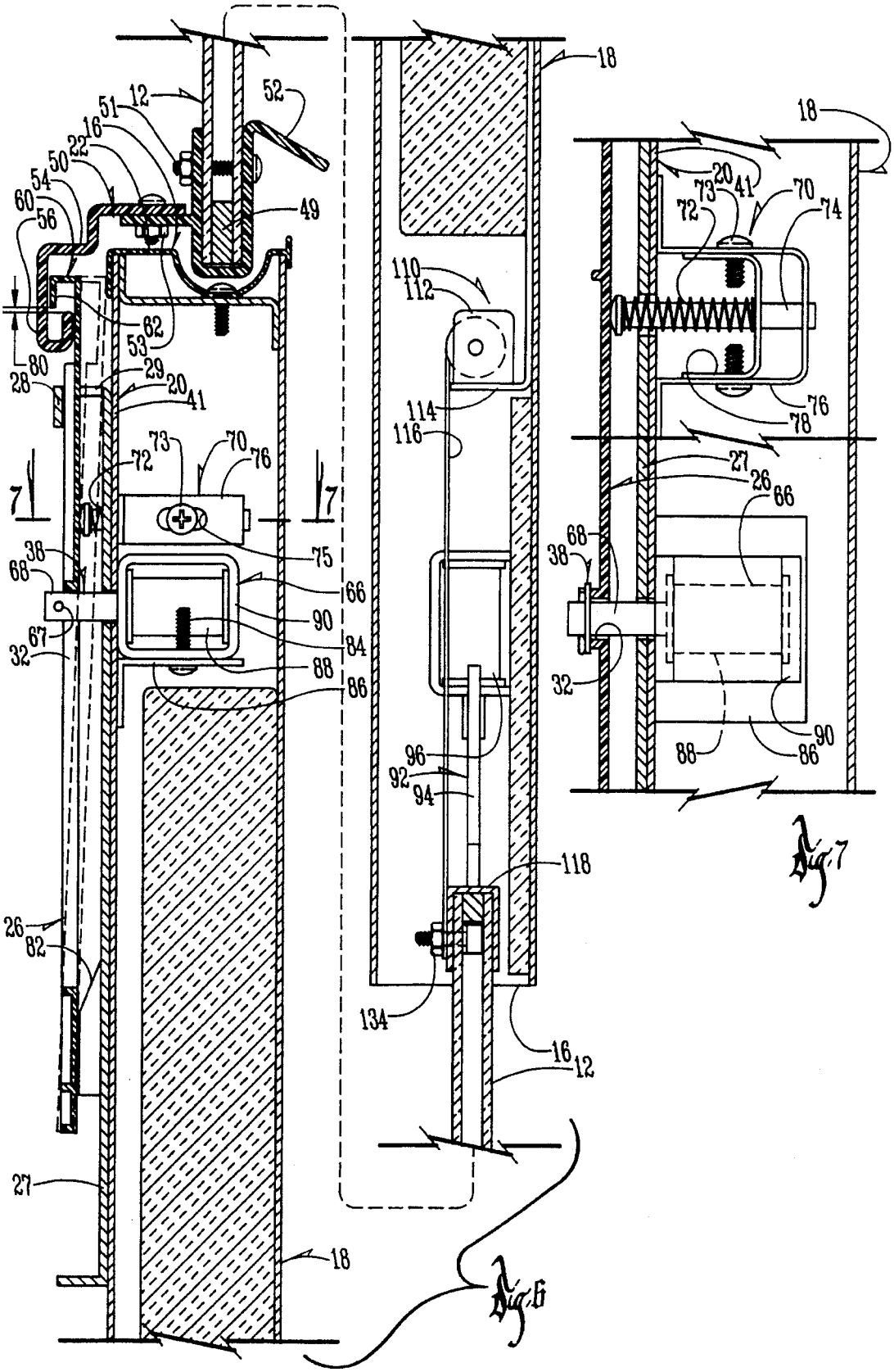
FIG. 6 is a sectional view taken along line 6—6 of FIG. 5.
FIG. 7 is a sectional view taken along line 7—7 of FIG. 6.

FIGS. 5–7 depict in more specific detail the structure of door 12 and shields 24 and/or 26, and how they interact according to the preferred embodiment of the invention. Lifting bar or window handle 52 (plastic - transparent rigid PVC) connected to the lower or trailing edge of door 12, can be one piece. Anchor bolts 51 (for example two of them) can be used along lifting bar 52 to insure it cannot be removed from door 12 by prying force. Bolts 51 pass through both panes of door 12 and a spacer 49. Lifting bar 52 allows the customer to lift door 12 from the outside the machine 10. Flange 50 is attached by bolts/nuts 53 and includes a formed lip or hook 54 including a distal end 56 having the shape of a "U" when taken in cross-section. The two pieces 52 and 50 allow the "hook point" (front to back) between ends 56 and 62 of flanges 50 and 60 respectively to be adjusted. Ends 56 and 62 are generally separated vertically ⅛" and the horizontal width of each is approximately ¼".

Shields 24 and 26 have flange 60 at their upper or leading edge that includes a distal end or hook 62 having spaced apart (serrated) portions which are the shape of an inverted "U" in cross-section. The serrated edge of flange 60 is used as the hook because the shields 24 and 26 are molded. Such an edge does not require side pulling cams in the mold which reduces complexity and cost. As shown in FIG. 6, when door 12 is in the normal down, closed position, distal ends of flange 50 and flange 60 (both painted 16 ga. (0.060") stainless steel)) are oriented such that a slight vertical gap (⅛" maximum—indicated at 80) exists between ends 56 and 62. This allows either shield 24 or 26 or both to be pulled horizontally away so that ends 56 and 62 would not interlock if door 12 is raised (see shield as shown in dashed lines in FIG. 6). If door 12 is raised vertically, and shield 24 and/or 26 is/are pulled away to the position of dashed lines in FIG. 6, door 12 and whichever shields (if any) are not pulled away will interlock causing the shield or shields not pulled away to move upwardly in a locked fashion with door 12 (see shield 24 lifted in FIG. 5). However, if either or both shield 24 and 26 is pulled laterally forward so that flange 60 separates from flange 50, access door 12 can be vertically raised and no interlocking and consequential coordinated upward movement of shield 24 and/or 26 would be made. Shields 24 and/or 26 would thus remain in the down or normal position. FIG. 5 shows shield 24 interlocked with door 12 and raised, and shield 26 non-interlocked and left in the down position.

Thus, shields 24 and 26 will move up and down with door 12 unless releasable actuators associated with either shield 24 and 26 are operated. In the preferred embodiment, the actuators are solenoids 66 which exist as shown in FIG. 5 and have solenoid arms 68 (or pins 38) which pass through slots 32 of shields 24 and 26 and locked to shields 24 and 26 by a roll pin 67 fixed through a transverse aperture towards the outer end of solenoid arm 68. In an inactivated state, arm 68 of solenoid 66 is extended to allow interlocking of flanges 50 and 60. However, activation of either solenoid 66 causes the respective arm 68 to be pulled further inside solenoid 66 which moves shield 24 or shield 26 laterally away from flange 50 (approximately ⅜inch) so that no interlocking is achieved between flanges 50 and 60 when door 12 is raised. Arm 68 is associated with the middle slot 32 of each shield 24 and 26 and therefore arm 68 rides in slot 32 when shields 24 and 26 are moved vertically. When arm 68 pulls either shield 24 and 26 away from flange 50, the respective shield(s) 24 and/or 26 would remain in its/their down or lowered position(s).

FIGS. 5 and 6 also illustrate the following. Ramps 82 (e.g. acetal plastic) are positioned towards the bottom of plate 27 (and can be attached to plate 27 by bolts, screws, or other means), vertically aligned with slots 38, and serve to help position shields 24 and 26 in their normal positions and as a fulcrum when either shield is pulled forwardly to separate flanges 50 and 60.

FIGS. 5–7 illustrate a spring loaded plunger 70, one for each shield 24 and 26, that urge shields 24 and 26 to the normal position shown in solid lines in FIG. 6 where flanges 50 and 60 are capable of interlocking. Spring 72 (FIG. 7) can be selected to provide a desired biasing force (e.g. 0.411" diameter, 0.030" wire, 1/14" long, 2.8#/1 inch, music wire, closed ends). Plunger arm 74 (e.g. acetal plastic) is slidable within bracket 76 which is fixed to plate 41 of wall 20. An adjust plate 78 is mounted to bracket 76 by bolts 73. The distance between plate 78 and plate 41 can be adjusted (because of slots 75 in bracket 76) to adjust the force of spring 72. This biasing of plunger 70 is overcomeable by operation of solenoid 66.

Each solenoid 66 (e.g. 24 VDC continuous duty (pull) box frame solenoid with custom plunger 68) is fixed to plate 41 by mounting (by bolts 84) of a plate 86 to plate 41 by means well within the skill of those skilled in the art. The coil 88 and housing 90 can be adjusted positionally and easily removed.

FIG. 5 shows an electronically controlled lock 92 having an arm 94 that is pivoted by operation of solenoid 96 (24 VDC continuous duty (pull) box frame solenoid, Dormeyer Industries B-22 Series). Arm 94 is pivoted away (see FIG. 5) to release door 12 for vertical movement. FIG. 6 shows arm 94 in its normal, non-pivoted position over the top edge of door 12, preventing its vertical movement. FIG. 5 also shows electrical micro-switch 98 (e.g. 10A-1/4 HP 125 VAC/250 VAC, 1/2A 125 VDC, 1/4A 250 VDC, 3A 125 VAC, 7 gram operating force (maximum), custom actuator), which senses whether door 12 is in the down, closed position or is opened, even slightly. If not down and locked microswitch 98 alerts the machine 10 and/or controller 4, and disables the motor of machine 10 from moving buckets 14.

FIGS. 5 and 6 also show the spring-assists 100 connected to the top of door 12 to help open it when authorized by controller 4. Door 12 returns to the down position by gravity once the customer releases it. FIG. 5 shows that spring assists 100 include spring housings 112 mounted by bolts, welding, or other methods to door stop 113 having a lower flange 114 that serves as a vertical movement limiter for door 12. Springs 116 are constant tension springs that have lower ends mounted by bolts 134 to a cap plate 118 that is also bolted to the top of door 12. Side end 120 of cap plate 118 extends beyond the width of door 12 and operates with arm 94 of solenoid 96 to lock window 12 in the down position. Slots 122 can be formed in door stop 113 to allow vertical adjustability of door stop 113 to adjust the amount of vertical movement of door 12.

It is to be understood that bolts 51 attaching flange 50 to door 12 can be nylon bolts with nylon nuts, the nuts arranged on the interior side of door 12 to prevent tampering and removal.

By referring to FIG. 6, it can be seen that bolt/nut combinations 134, holding springs to the top of door 12, can do so with screws that are internal studs between the panes of glass of door 24. Other methods of attachment are possible.

D. Operation

The preferred embodiment can operate as follows. A customer would approach machine 10, visually review the choices and rotate a desired bucket to the vend position. The customer would then go to master unit 2, insert the correct money and select machine 10. Master control 4 would issue a signal to solenoid lock 92 that locks access door 12 in its down or normal position, to release access door 12 for vertical movement. Depending upon whether only a single vendable item is in bucket 14, or whether bucket 14 is divided into sections, when door 12 is raised, one of the following will occur:

1. Left shield 24 will be left in the down or normal position and right shield 26 will interlock with door 12 and be raised. This will uncover the left side of a segregated bucket 14 so that the user can withdraw only the vendable item on that side of bucket 14.

2. Right shield 26 will be left in the down or normal position and left shield 24 will raise with door 12.

3. Both left and right shields 24 and 26 will remain in the normal down position and the entire bucket 14 will be accessible to the user, whether divided or not by a divider wall.

4. A fourth option would be that if somehow a customer unlocked door 12, or by mistake door 12 was allowed to be vertically raised, both shields 24 and 26 would interlock with door 12. Even if door 12 was raised, a person would not be able to gain access to any bucket 14.

Once the item is removed by the customer, door 12 will return by gravity to a closed position. microswitch 98 will sense that the door 12 is in the down position then reinstigate the lock caused by solenoid 96. If for any reason door 12 does not return to its down and closed position, microswitch 98 will inform machine 10 accordingly and the mechanism to rotate buckets 14 will be disabled thereby precluding access to any other bucket.

The relationship of flanges 50 and 60 is such that the interlocking precludes a customer from unlocking either shield 24 and/or 26 if they interlock and raise with door 12.

It is to be understood that the invention is useable with the master/slave combination of machines described above, but of course an also be used with a stand alone vending machine.

E. Options, Alternatives And Features

It will be appreciated that the present invention can take many forms and embodiments. The true essence and spirit of this invention are defined in the appended claims and it is not intended that the embodiment of the invention presented herein should limit the scope thereof. Variations obvious to one skilled in the art will be included within the invention defined by the claims.

For example, the system of the main door and shields can be applied to any situation where a single door is utilized to gain access to a variety of different items. It is not limited to bucket machines.

Shields 24 and 26 are preferable opaque, to prevent view of any vendable item in a non-selected side. They can be translucent or even clear. They are preferably made of strong, tamper-proof materials.

Furthermore, the invention is not limited to two independently operated shields. The invention could function with simply one shield or it is possible that each bucket could be subdivided into more than two sections and then a corresponding number of shields could be utilized with the attended structure to operate them as explained above with regard to shields 24 and 26. Also, buckets 14 are shown divided 50/50. They could be divided for example 60/40, or some other percentage. Shields 24 and 26 would then have to be of proportional width and appropriately correlated to the same equal sides of bucket 14.

Still further, the exact apparatus by which any of the functions are accomplished could vary. For example, substitute for solenoids could be used. Such as electric motors, or other types of actuators. The exact structure of the shields could also vary including the manner in which they are slideably retained to machine 10. The precise shape and even the way in which interlocking between door 12 and any shields occur could vary.

We claim:

1. A vending machine having a housing, at least one interior generally horizontal support member for supporting a vendable item, the support member being moveable to a position directly in front of an exterior opening in the housing, a door vertically slidable between a closed position covering the exterior opening and blocking access to the support member and an open position allowing a customer access to the support member, the improvement comprising:

a wall dividing the support member into two sections, each section capable of supporting a vendable item;

a shield member supported in a frame mounted to the housing below the opening in the housing and slideably between a normal position substantially below the opening and a blocking position over at least a portion of the opening blocking access to at least a portion of the support member; and a releasable connection between the door and the shield member, the connection in a normal state locking the door and the shield member together if the door is raised from its closed position so that vertical movement of the door results in vertical movement of the shield member, the connection in a released state allowing vertical movement of the door without corresponding vertical movement of the shield member.

2. The vending machine of claim 1 wherein the machine is a rotating bucket machine and the support member is a bucket of the bucket machine.

3. The vending machine of claim 1 wherein the support member is substantially of similar width to the width of the door.

4. The vending machine of claim 1 wherein a releasable locking mechanism is associated with the door to preclude raising of the door until authorized.

5. The vending machine of claim 1 wherein the support member is dividable by one or more walls into two or more sections.

6. The vending machine of claim 1 further comprising a plurality of shields, one shield for each section of the support member.

7. The vending machine of claim 6 wherein each shield is aligned side-by-side in generally the same plane.

8. The vending machine of claim 1 wherein each shield includes a guide member to guide its slidable movement relative to the housing.

9. The vending machine of claim 1 wherein the releasable connection comprises an actuator member mounted to the housing at one side and connected to the shield, the actuator having an arm which, upon instruction from the machine, moves the shield relative to the door.

10. The vending machine of claim 9 wherein the actuator comprises an electrical solenoid.

11. The vending machine of claim 9 wherein the releasable connector further comprises a first lip on the door and a second lip on the shield, the first and second lips cooperating to interlock when the door is moved vertically and no instruction from the machine is received so that the shield moves upwardly with the door, the first and second lips cooperating to not interlock when the door is moved vertically and an instruction is received from the machine so that the shield does not move upwardly with the door.

12. A method of allowing at least two selections from a single bucket of a rotating type bucket vending machine having a window/door that corresponds with an indexing position of a bucket and which can be vertically raised to allow access to all parts of a bucket which is indexed to the indexing position, comprising:

partitioning the bucket into at least two sections;

blocking off one of the two sections which is not selected by the customer when the window/door is raised, the blocking being accomplished by shielding the non-selected section by a shield that moves with the window/door.

13. An apparatus to increase the number of vendable selections from a single bucket of a bucket type vending machine which allows the customer to select vendable items by a selection input correlated to a specific bucket and the machine rotates the specific bucket to an indexed position in front a sliding door, the door normally being locked in a closed position, but being released when the selection input is made and validated by the machine, comprising:

a flange mounted on a trailing end of the door, the flange having a hook;

a shield slideably mounted adjacent the door and having a flange on a leading end, the flange having a hook;

the hooks of the door and the shield aligned in the same general plane when the shield is in a normal position so that the hooks engage when the door is moved and the shield moves with the door when the door is moved; and an actuator connected between the shield and the machine, the actuator including a member which is moveable in response to an instruction from the machine to move the shield to a non-aligned position with respect to the door so that the hook of the shield will not will not engage with the hook of the door when the door is moved.

14. A bucket dividing and dispensing system for a bucket type vending machine having a door which in a normal position covers an opening in the machine and is slidable away from the opening to allow access to all portions of a bucket brought in front of the door comprising:

a plurality of secondary doors normally slideably positioned in the machine out of the opening;

a hook on a trailing end of the door;

a hook on a leading end of each secondary door;

the hooks on the door and each secondary door generally aligned to interlock if the door is moved;

a connection on each secondary door; and a mechanism connected to each connection on each secondary door, each mechanism including an moveable member which moves a corresponding secondary door to a position that does not allow the hook of the secondary door to interlock with the hook of the door when the door is moved.

* * * * *

UNITED STATES PATENT AND TRADEMARK OFFICE

CERTIFICATE OF CORRECTION

PATENT NO. : 5,533,645

DATED : July 9, 1996

INVENTOR(S) : Wittern, et. al.

It is certified that error appears in the above-indentified patent and that said Letters Patent is hereby corrected as shown below:

In Claim 11, column 10, line 51, please delete connector and substitute --connection--.

In Claim 13, column 11, line 9, please insert --of-- following the word "front".

In Claim 13, column 12, line 2, please change "will not will not" to read --will not--.

In Claim 14, column 12, line 19, please delete "an" and substitute --a--.

Signed and Sealed this

Twenty-second Day of October, 1996

Bruce Lehman

*Attest:*

BRUCE LEHMAN

*Attesting Officer*

*Commissioner of Patents and Trademarks*